US011491626B1

(12) United States Patent
Horgan

(10) Patent No.: US 11,491,626 B1
(45) Date of Patent: Nov. 8, 2022

(54) ADJUSTABLE WEIGHT DEAD BLOW HAMMER

(71) Applicant: Thomas B. Horgan, Marysville, WA (US)

(72) Inventor: Thomas B. Horgan, Marysville, WA (US)

( * ) Notice: Subject to any disclaimer, the term of this patent is extended or adjusted under 35 U.S.C. 154(b) by 0 days.

(21) Appl. No.: 17/732,463

(22) Filed: Apr. 28, 2022

Related U.S. Application Data

(60) Provisional application No. 63/181,918, filed on Apr. 29, 2021.

(51) Int. Cl.
*B25D 1/00* (2006.01)

(52) U.S. Cl.
CPC ..... *B25D 1/00* (2013.01); *B25D 2250/391* (2013.01)

(58) Field of Classification Search
None
See application file for complete search history.

(56) References Cited

U.S. PATENT DOCUMENTS

| | | | | |
|---|---|---|---|---|
| 2,432,450 | A | 12/1947 | Sears | |
| 3,088,506 | A * | 5/1963 | Bianchini | B25D 1/12 81/19 |
| 3,343,576 | A | 9/1967 | Norcross | |
| 5,082,279 | A | 1/1992 | Hull et al. | |
| 5,216,939 | A | 6/1993 | Swenson | |
| 5,408,902 | A | 4/1995 | Burnett | |
| 6,595,087 | B2 | 7/2003 | Whalen et al. | |
| 8,177,192 | B1 | 5/2012 | Taylor et al. | |
| 8,702,530 | B2 | 4/2014 | Slaughter et al. | |
| 9,586,073 | B2 | 3/2017 | Walker | |
| 10,611,010 | B1 | 4/2020 | Anderson | |
| 2005/0252345 | A1 * | 11/2005 | Carmien | B25D 1/045 81/22 |
| 2014/0216210 | A1 | 8/2014 | Near | |
| 2014/0259695 | A1 | 9/2014 | Guynn et al. | |
| 2020/0078916 | A1 | 3/2020 | Doner | |

FOREIGN PATENT DOCUMENTS

EP 0204533 A1 12/1986

* cited by examiner

*Primary Examiner* — Brian D Keller
(74) *Attorney, Agent, or Firm* — Binita J. Singh; Bold IP, PLLC

(57) ABSTRACT

The present invention is an adjustable weight dead blow hammer comprising a hollow head filled with an acceptable fill material. A handle is connected to the head wherein the handle has a hollow chamber that traversers the length of the handle and has an opening into the head. The weight of the hammer head may be adjusted by moving the fill material between the head and the hollow chamber in the handle. Adjustment may be accomplished by a corkscrew device which is disposed within the hollow chamber and having a screw tip at the opening and c screw head on an outside portion of a bottom end of the handle. The corkscrew device within the hollow chamber moves the fill material between the head and the handle. More fill material in the head increases the force of impact, and less fill material in the head decreases the force of impact.

15 Claims, 3 Drawing Sheets

ADJUSTABLE WEIGHT DEAD BLOW HAMMER

CROSS-REFERENCE TO RELATED APPLICATIONS

This application is a non-provisional application which claims priority to U.S. Provisional Patent Application No. 63/181,918 filed on Apr. 29, 2021, which is incorporated by reference in its entirety.

FIELD OF DISCLOSURE

The overall field of this invention generally pertains to handheld striking tools for striking objects and in particular to specialized mallets such as dead blow hammers.

BACKGROUND

There are many different types of hammers. Each type is designed for a certain function and the task that is being performed. A dead blow hammer is a specialized type of mallet and is designed to drive a lot of force without marring the object being hammered. Essentially, a dead blow hammer strikes with a lot of force and does not rebound after each strike. These types of hammers are used in automotive and aerospace industries, for setting joints, dent removal, and other uses.

A typical dead blow hammer is a solid polymer mallet with a large blunt striking face. The head of the hammer is typically hollow and filled with lead shot, sand, or steel shot to distribute the strike over a longer stretch of time. Basically, when the hammer is swung the shot lands dispelling all of the energy into the object being struck. This virtually eliminates any rebound within the hammer's head, which is a common problem with a standard mallet. The shot delivers a great deal of force per swing without the hammer needing to be very heavy. However, dead blow hammers come in different weights and the different weights are important for the function being performed where different striking forces may be necessary. The most commonly used dead blow hammer weights range anywhere in between 1 pound to 3 pounds. However, dead blow hammers with weights up to 24 pounds also exist. Thus, it is common for someone working with dead blow hammers to acquire and use multiple dead blow hammers with varied weights for their various purposes.

A common problem faced is that multiple hammers need to be carried to have the proper weighted dead blow hammer for a particular purpose. Another problem faced is that a suitable weighted hammer may not be immediately available or be in the repertoire of a worker's toolbox. Thus, the choice may be to carry excess weight with multiple hammers or use a dead blow hammer that is not suitable for the specific purpose and therefore perform ineffectively.

Accordingly, there remains a need for a simple and effective means to address the above problems with currently available dead blow hammers.

SUMMARY

According to one embodiment, one or more embodiments are provided below for an adjustable weight dead blow hammer adapted to allow the weight of a head to be adjusted. In one or more embodiments, an adjustable weight dead blow hammer is disclosed which comprises of a hollow head filled with any acceptable weight material, including, but not limited to, sand, appropriately weighted pellets made of various materials such as steel and lead, and so forth. The hammer also comprises a handle extending from the head wherein the handle has a hollow chamber. The hollow chamber in the handle may have an opening at a first, top end which is connected to the head. The hammer has an adjustment means to move the weight material between the head and the handle. In one or more non-limiting embodiments, the adjustment means comprises of an adjustment screw which may be located on a second, bottom end of the handle which moves a corkscrew device within the handle. The corkscrew device extends from the bottom end of the handle to the top end of the handle at the opening to the head. When the adjustment screw is moved, it causes the weight material to move between the head and the handle. More weight material in the head increases the force of impact, and less weight material in the head decreases the force of impact.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
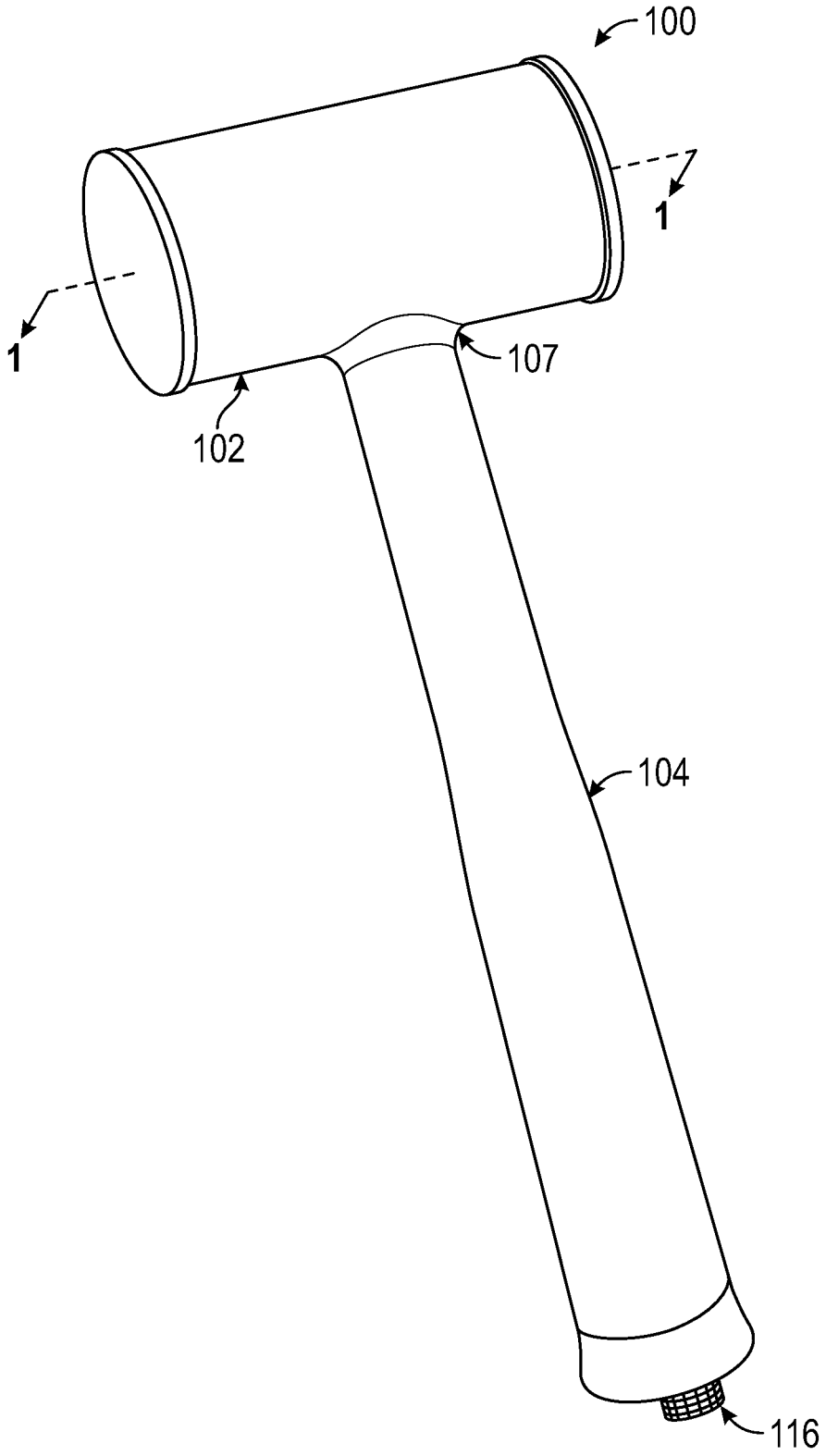
FIG. 1 is an example of an adjustable weight dead blow hammer

In the Summary above and in this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" may be used herein to mean "serving as an example, instance, or illustration." Any aspect described in this document as "exemplary" may not be necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure recognizes the unsolved need for an improved and effective means of addressing the dead blow limitation described above. It is an object of the present invention to provide a dead blow hammer which may be applied to various projects requiring different levels of strike weights. It is also the object of the present invention to provide a dead blow hammer that may easily be adjusted to vary the striking weight. Additionally, it is also the object of the present invention to ensure that a suitable weighted dead blow hammer is almost always available. Other aspects and advantages of the present disclosure will become apparent upon consideration of the following description.

The present disclosure is for an adjustable weight dead blow hammer wherein multiple striking weights may be carried in one single dead blow hammer. Throughout this disclosure, the "adjustable weight dead blow hammer" may also be referred to as a "hammer" for purposes of brevity. The hammer is configured to allow the redistribution of a weighted material, preferably sand or metal pellets, from a head to a handle and vice versa of the adjustable weight dead blow hammer.

In one or more embodiments, an adjustable weight dead blow hammer is disclosed which comprises of a hollow head filled with any acceptable weight material, including, but not limited to, sand, appropriately weighted pellets made of various materials such as lead and steel, and so forth. The hammer also comprises a handle extending from the head. The handle has a hollow chamber that traversers a length of the handle from a first end to a second end. The hollow chamber in the handle may have an opening at the first end, which may be defined as a top end connected to the head. The hammer has an adjustment means to move the weight material between the head and the handle. In one or more non-limiting embodiments, the adjustment means comprises of an adjustment screw head which may be located on the second end, defined as the bottom end of the handle which moves a corkscrew device within the hollow chamber of the handle. The corkscrew device extends from the bottom end of the handle to the top end of the handle at the opening to the head. When the adjustment screw head is moved, it causes the weight material to move between the head and the handle. More weight material in the head increases the force of impact, and less weight material in the head decreases the force of impact.

In the presently disclosed hammer, the effective dead blow weight of the hammer may be adjusted by up to half of the maximum starting weight. As an example of the presently disclosed hammer, a maximum starting weight on a dead blow hammer of 2 pounds may be adjusted down to 1 pound and anywhere in between. Thus, this adjustable dead blow hammer eliminates the need to own different weights of dead blow hammers and allows multiple hit weights within a single hammer. Also, an advantage of the adjustable dead blow hammer is that the weight can be adjusted by any amount.

The adjustable weight dead blow hammer of the present disclosure and discussed in one or more embodiments herein may be configured with the typical materials, general design, and general dimensions of presently known and any future dead blow hammers. For example, the most common dead blow tools are encased with plastic or a rubber-like substance. However, the present disclosure is not intended to be limited to these materials only. It is also contemplated that the dead blow hammer of the present invention may be reinforced with another material encased with the plastic or the rubber-like substance. The reinforced material may include a metal such as and not limited to steel. Therefore, the hammer of the present invention may come in many types to offer weight adjustability for various applications. Therefore, a person skilled in the arts would appreciate that the present invention of the adjustable weight dead blow hammer may come in many types including, and not limited to, a slim soft face, a standard soft face, a ball peen, a flat-flat hard face, and polyurethane bossing mallets.

Referring now to FIG. 1, a perspective view of a non-limiting example of an adjustable weight dead blow hammer 100 is depicted. As mentioned above, the adjustable weight dead blow hammer 100 may be interchangeably referred to as a hammer 100 throughout the remainder of the disclosure. The hammer 100 generally comprises a head 102 and a handle 104, wherein the head 102 is connected to the handle 104 at a connection point 107. Generally, the head 102 is connected to a top end of the handle 104, wherein the head 102 may be considered as resting on top of the handle 104. A bottom end of the handle 104 is shown with an adjustment screw head 116 which is connected to a corkscrew device (See FIGS. 2 and 3, 118 and 218, respectively).

Figure 2:
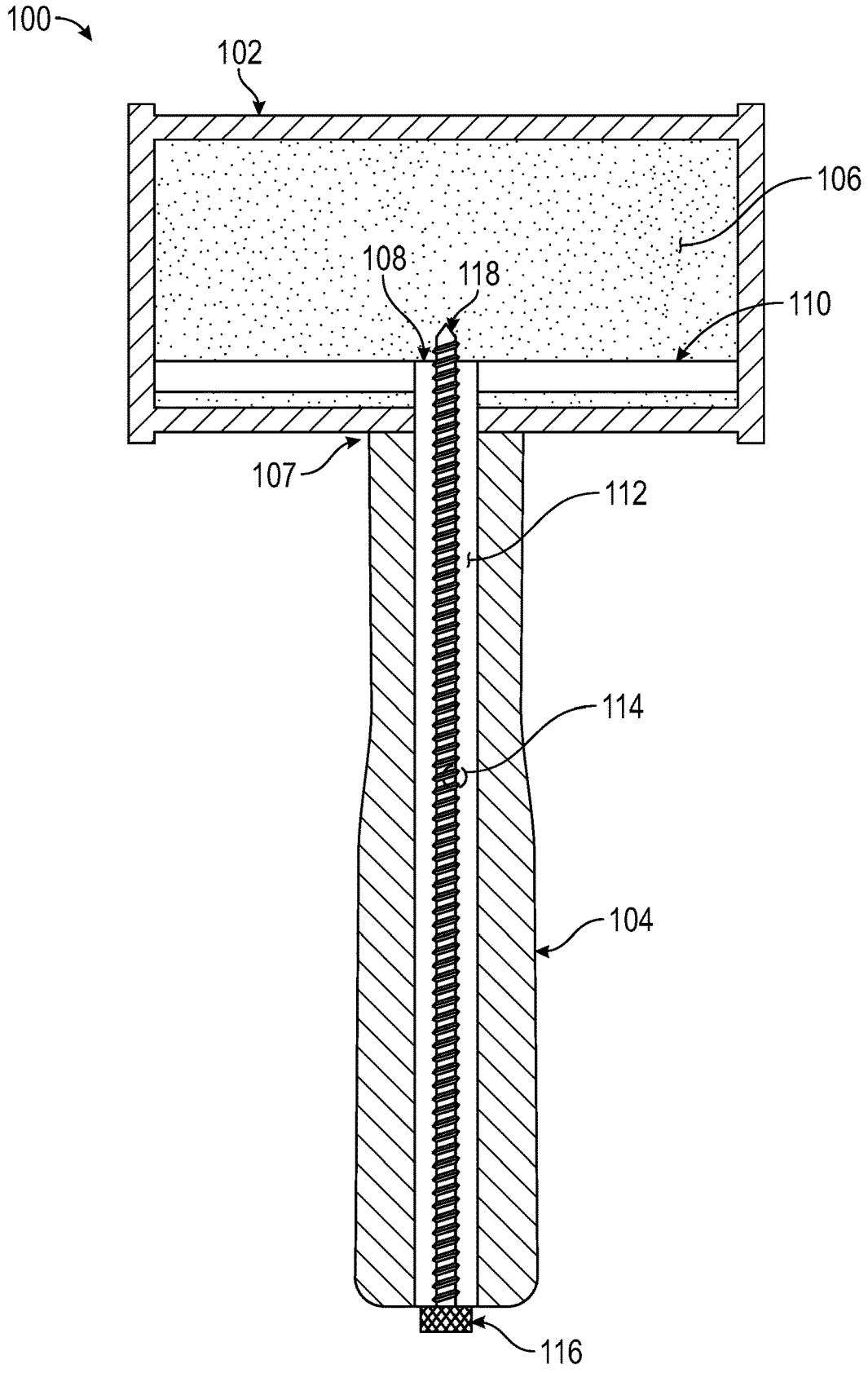
FIG. 2 is a cross sectional view of an embodiment of an adjustable weight dead blow hammer taken along line 1-1 depicting an example of an adjustment mechanism.

FIGS. 2 shows a cross-sectional view of the hammer 100 taken along line 1-1 in FIG. 1. The hammer 100 is shown to be comprised of the head 102 connected to the handle 104, wherein the head 102 and the handle 104 have a common opening at the connection point 107 which is the point at which they meet, collectively referred to as an opening 108. A grommet 110 may be incorporated within the head 102 which surrounds the opening 108. The head 102, as is typical of most dead blow hammers, is hollow and partially filled with freely movable fill material 106. Non-limiting exemplary fill materials include and are not limited to sand, pellets, and so forth. The hammer 100 also comprises a hollow chamber 112 within the handle 104. An internal screw 114 extends through the hollow chamber 112 with a tip portion 118 that extends into the head 102 through the opening 108 and a screw head 116 on a bottom end of the handle 104.

The hollow chamber 112 within the handle 104 of the adjustable dead blow hammer 100 may be relatively centrally within the handle 104 and may extend from the top portion of the handle 104 to the bottom portion of the handle 104. The hollow chamber 112 at the top portion of the handle coincides with the opening 108 between the head 102 and the handle 104. Thus, the hollow chamber 112 of the handle 104 opens into the head 102. The hollow chamber 112 may be directly integrated into the handle 104 or alternatively the hollow chamber 112 may be incorporated with a hollow metal rod (not shown) that is open at a top end; that is, the end which opens into the head 102.

As shown in FIG. 2, the internal screw 114 extends the entire length of the hollow chamber 112. The screw tip 118 may extend slightly into the head 102 and the screw head 116 rests on an outside portion of the bottom end of the handle 104. It is also contemplated that alternatively the screw tip 118 may only extend up to the opening 108 and not extend into the head 102 of the hammer 100. In one or more embodiments, the grommet 110 is provided and connected on the inside hollow portion of the head 102 by being positioned over the opening 108 such as to cover edges of the opening 108. The grommet 110 is provided to protect the opening 108 and the fill material 106 as it is moved through the opening 108 when making adjustments to the strike weight in the head 102. The grommet 110 may be made from any material known in the arts that are usually used to make grommets, such as and not limited to metal and rubber.

As discussed above, the fill material 106 is enclosed in the hollow portion of the head 102. The fill material 106 may be moved between the head 102 and the hollow chamber 112 in the handle 104 through the opening 108. For example, a basic demonstration of the application of adjusting the strike weight of the adjustable weight dead blow hammer 100 may operate by drawing the fill material 106 from the head into the hollow chamber 112 within the handle 104. The internal corkscrew 114 is characterized as having threads and the threads at the screw tip 118 that goes through the grommet 110 at the opening 108 may have protruding ribs (not shown) that stand at 90 degrees from the screw threads. These protruding ribs on the threads at the screw tip 118 cover an entire width of the opening 108 and an entire width of the hollow chamber 112. Essentially, the protruding ribs at the screw tips prevent the fill media 106 from falling into the hollow chamber 112 in the handle 104. The screw head 116 is turned clockwise and counterclockwise to move the fill material 106 in and out of the hollow chamber 112 to adjust the strike weight. In one or more non-limiting embodiments, the head 102 may include a see-through window that allows a user to see the amount of fill material in the head 102. It is to be understood that the handle 104 may also include a see-through window along a length of the handle commensurate with the hollow chamber 112 to see the amount of fill material in the handle 112. It is also to be understood that both the head 102 and the handle 104 may have the see-through window or only one may have a see-through window.

An example method of how to move the fill material 106 is described. Holding the hammer 100 vertically with the head 102 positioned above the handle 104, the screw head 116 may be turned in either direction to draw the fill material 116 into the hollow chamber 112 in the handle 104 through the opening 108. As the fill material 106 material is drawn into the hollow chamber 112 in the handle 104, a strike weight of the head is reduced. To move the fill material 106 in the hollow chamber 112 back into the head 102, the hammer 100 is held vertically with the head 102 positioned below the handle 104. As the screw head is rotated, the fill material 106 is drawn into the head 104. This increases the strike weight of the head 102. In both cases, gravity aids in moving the fill material 106 through the opening 108 as the screw head 116 is turned.

Figure 3:
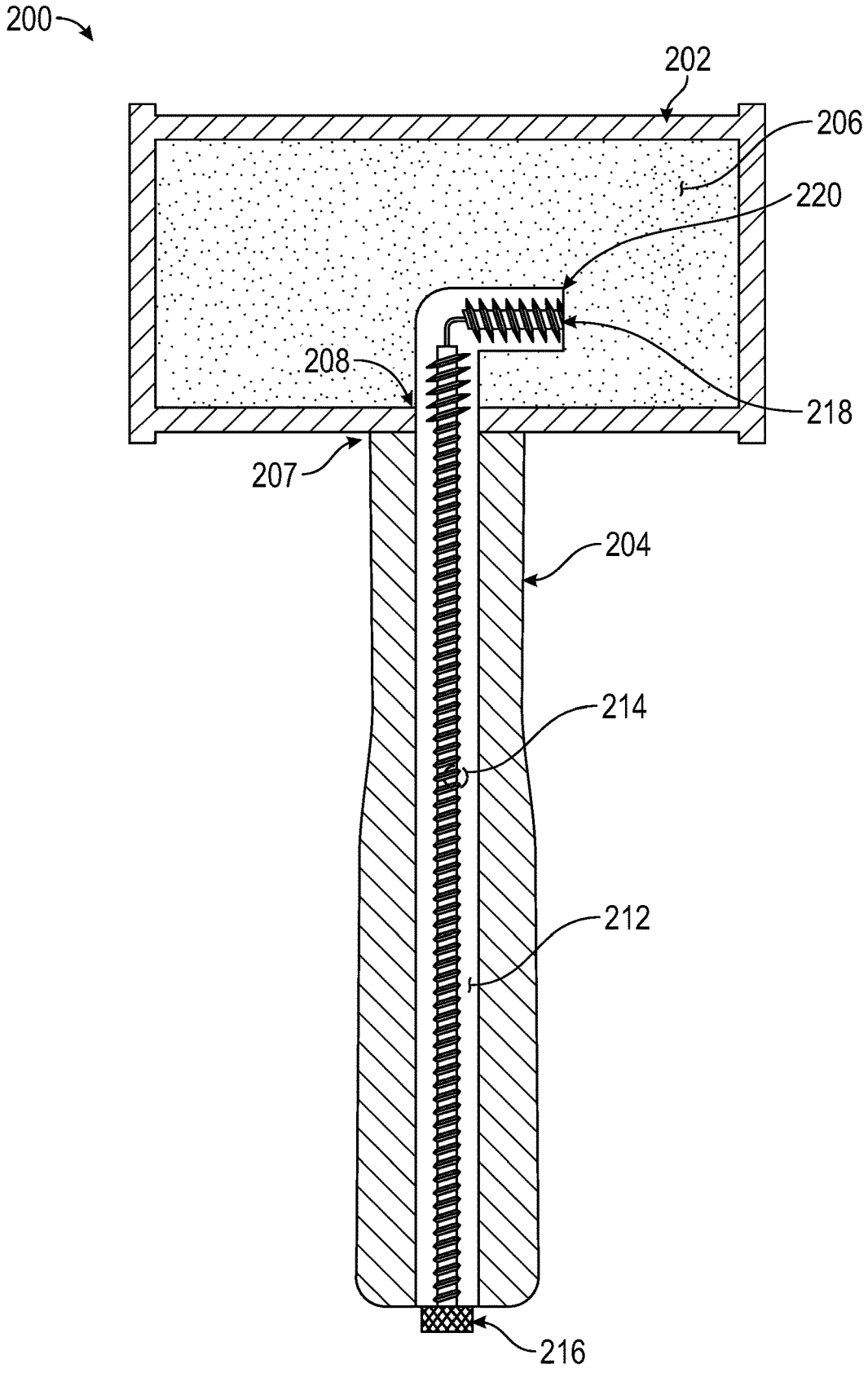
FIG. 3 is a cross-sectional view of an alternate embodiment of an adjustable weight dead blow hammer taken along line 1-1 depicting an alternate example of an adjustment mechanism.

An alternate embodiment of an adjustable weight dead blow hammer 200 is illustrated in FIG. 3. As in the embodiment discussed in FIG. 1, the hammer 200 also generally comprises a head 202 and a handle 204, wherein the head 202 sits on top of the handle 204 which has a common opening at the point at which they are adjoined (a connection point 207), and collectively referred to as an opening 208. The head 202 is hollow and partially filled with freely movable fill material 206. The hammer 200 also comprises a hollow chamber 212 within the handle 204 which extends from a top portion of the handle 204 to a bottom portion of the handle 204. The hollow chamber 212 opens into the head 202 at the opening 208 wherein a width of the opening 208 and a width of the hollow chamber 212 are substantially similar. The hollow chamber 212 may be configured directly into the handle 204 or alternatively may be reinforced with a hollow metal rod (not shown) that extends the entire length of the hollow chamber 212 and opens into the opening 208.

The hammer 200 in FIG. 2 is also shown with a hollow tube fitting 220 having a bend which may be configured onto the opening 208 within the head 202 and may be of a similar width as the opening 208. The bend in the hollow tube fitting 220 may be such that the hollow tube fitting 220 extends slightly into the head and bends away from the opening 208 forming an angle at the bend, such as a right angle. An example of a tube fitting may include, and not be limited to, a 90-degree elbow fitting and any other type of fitting with a bend may be used. An internal screw 214 is disposed within and extends through the hollow chamber 212 with a bent screw tip 218 that extends into the elbow fitting 220 through the opening 208. The screw tip 218 includes a bend which is commensurate with the bend in the elbow fitting 220. The screw tip is provided at an opening of the hollow tube fitting 220 which opens up into the head 202.

The nature of the bend in the elbow fitting 220 with the screw tip 218 disposed within should likely prevent the fill material 206 from moving into the hollow chamber 212 in the handle 204. Alternatively, because the internal screw 214 is characterized as having threads, the threads on the screw tip 218 may be provided with protruding ribs (not shown) that stand at 90 degrees from the threads. These protruding ribs on the threads at the screw tip 218 may cover the entirety of the width of the hollow elbow fitting 220. The protruding ribs at the screw tips 218 prevent the fill media 206 from falling into the hollow chamber 212 in the handle. In both designs, the screw head 216 is turned clockwise and counterclockwise to move the fill material 206 in and out of the hollow chamber 112 to adjust the strike weight. In one or more non-limiting embodiments, the head 202 may include a see-through window that allows a user to see the amount of fill material in the head 202. It is to be understood that the handle 204 may also include a see-through window along a length of the handle commensurate with the hollow chamber 212 to see the amount of fill material in the handle 212. It is also to be understood that both the head 102 and the handle 104 may have the see-through window or only one may have a see-through window.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A striking device, comprising:

a head disposed on a top of a handle at a connection point, wherein the head is hollow and filled with a fill material;

the handle having a top end and a bottom end, wherein a hollow chamber traverses a length of the handle from the top end to the bottom end;

an opening at the connection point between the head and the handle, wherein the hollow chamber at the top end of the handle is open to the head; and a corkscrew device extending a length of the hollow chamber from the top end to the bottom end, wherein the corkscrew device includes threads whereby the fill material is moved between the head and the hollow chamber in the handle as the corkscrew device is turned within the hollow chamber.

2. The striking device of claim 1, wherein the hollow chamber is centrally placed within the handle.

3. The striking device of claim 1, wherein a width of the hollow chamber is equal to a width of the opening at the connection point.

4. The striking device of claim 1, the corkscrew device having a screw tip and a screw head, wherein the screw tip is provided at the opening of the top end of the handle and the screw head is provided on an outside portion of the bottom end of the handle.

5. The striking device of claim 1, wherein a grommet is connected within the head and positioned over the opening at the connection point.

6. The striking device of claim 1, wherein the fill material is chosen from a list comprising sand, steel shot, and lead shot.

7. A striking device, comprising:

a head disposed on a top of a handle at a connection point, wherein the head is hollow and filled with a fill material;

the handle having a top end and a bottom end, wherein a hollow chamber traverses a length of the handle from the top end to the bottom end;

an opening at the connection point between the head and the handle, wherein the hollow chamber at the top end of the handle is connected to a hollow tube fitting which opens to the head; and a corkscrew device disposed within the hollow chamber extending a length of the hollow chamber from the top end to the bottom end and extending an entire length of the hollow tube fitting, wherein the corkscrew device includes threads whereby the fill material is moved between the head and the hollow chamber in the handle as the corkscrew device is turned within the hollow chamber and the hollow tube fitting.

8. The striking device of claim 7, wherein the hollow chamber is centrally placed within the handle.

9. The striking device of claim 7, wherein a width of the hollow chamber is equal to a width of the opening at the connection point.

10. The striking device of claim 7, wherein the hollow tube fitting extends into the head from the opening and includes a bend proximal to the opening, wherein the bend forms an angle.

11. The striking device of claim 10, wherein the bend in the hollow tube fitting is a right angle.

12. The striking device of claim 7, wherein a width of the hollow tube fitting is equal to a width of the opening at the connection point.

13. The striking device of claim 7, wherein the corkscrew device disposed in the hollow tube fitting includes a bend commensurate with a bend in the hollow tube fitting.

14. The striking device of claim 13, the corkscrew device having a screw tip and a screw head, the screw tip is provided at an opening of the hollow tube fitting into the head and the screw head is provided on an outside portion of the bottom end of the handle.

15. The striking device of claim 7, wherein the fill material is chosen from a list comprising sand, steel shot, and lead shot.

* * * * *